United States Patent [19]

Filipetti

[11] 4,253,372

[45] Mar. 3, 1981

[54] T-3.TRIPLE THICK TRIPLE TIP PICK

[76] Inventor: David E. Filipetti, 175 B Ann St., Hartford, Conn. 06103

[21] Appl. No.: 38,635

[22] Filed: May 14, 1979

Related U.S. Application Data

[63] Continuation-in-part of Ser. No. 897,343, May 18, 1978, abandoned.

[51] Int. Cl.[3] ..... G10D 3/16
[52] U.S. Cl. ..... 84/322
[58] Field of Search ..... 84/322

[56] References Cited

U.S. PATENT DOCUMENTS

| | | | |
|---|---|---|---|
| 2,170,179 | 8/1939 | Wolcott | 84/322 |
| 2,449,890 | 9/1948 | Garlick | 84/322 |
| 2,481,759 | 9/1949 | Lawrence | 84/322 |
| 2,484,820 | 10/1949 | Galetzky | 84/322 |

*Primary Examiner*—Lawrence R. Franklin

[57] ABSTRACT

The disclosed guitar pick is a completely inflexible stringed instrument plectrum, ideally 3MM±15% thick; three specific tip shapes and edge tapers, offer the selection of mutually exclusive and distinctly different unyielding picking points. This shape and taper gradient results in a different "feel", articulation, and string attack for each of the three available tips.

6 Claims, 3 Drawing Figures

T-3.TRIPLE THICK TRIPLE TIP PICK

This is a continuation in part of Ser. No. 897,343, filed May 18, 1978, now abandoned.

Although other plectrum teach the utility of a plurality of picking points, none have dealt, as in this present disclosure, with a selectable-shape-attack-non yield-taper gradient. It was once thought that flexibility was an important attribute of plectrum. In the disclosed design, however, control articulation and string to string tolerances can be greatly increased, facilitating right hand development and accuracy, since complete rigidity, as embodied in this disclosure, eliminates pick recall, flap and imprecision.

Figure 1:
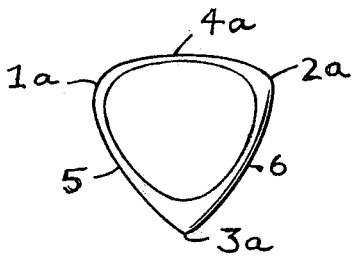
FIG. 1 is a top view of the disclosure, showing the three tip shapes.

To further enumerate the specific structure and nature of said pick, reference is directed to FIG. 1 (top view).

The distance between points 1*a*–6; 2*a*–5; 3*a*–4*a* is 30 MM±15% respectively.

Tip 1*a* is rounded with an arc, tangent to extended intersecting edge lines 4*a* and 5, by a radius of 6 MM±15%. Tip 2*a* is rounded with an arc tangent to extended intersecting edge lines 4*a* and 6, by a radius of 3 MM±15%. Tip 3*a* is rounded with an arc, tangent to extended intersecting edge lines 5 and 6, by a radius of 1.5 MM.

Figure 2:
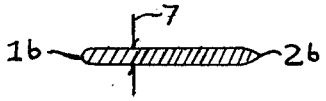
FIG. 2 is a front view, showing two of the three edge tapers.

In FIG. 2 (front view), taper 1*b* is formed by the intersection of two arcs, 3 MM±15% apart, i.e. the thickness of the body of said plectrum, each arc having a radius of 1.5 MM±15%. Taper 2*b* is formed, in the same way, by two intersecting arcs, each having a radius of 3 MM±15%. The distance between dimension 7, that is, the thickness of the body of the pick, is 3 MM±15%. It can be readily noted from 7 i.e., 3 MM±15%, that the design is at least three times the thickness of conventional plectrum, always under one millimeter. This allows for less total pick movement between strings i.e. increases string to string tolerances and secures a firmer grasp of said pick, facilitating better pick control and accuracy.

Figure 3:
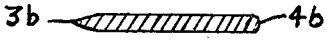
FIG. 3 is a side view, showing the third remaining taper and edge wall.

In FIG. 3 (side view), taper 3*b* is formed by the intersection of two arcs, 3 MM±15% apart, each arc having a radius of 15 MM±15%. Taper 4*b* is representative of all non-tip edge walls.

THE THREE TIP CHARACTERIZATIONS:

(A) Sharp tip 3*a* (FIG. 1) with long taper 3*b* (FIG. 3), provides a clear, crisp attack with the most articulation.

(B) Blunt tip 1*a* (FIG. 1) with short taper 16 (FIG. 2), provides a smooth harmonic inducing attack, which glides off the strings.

(C) Medium tip 2*a* (FIG. 1) with medium taper 2*b* (FIG. 2), provides an attack and feel between A and B above.

It is centrally important in the design, to use materials which are nonyieldable at the specified dimensions. Materials such as: stone, acrylic, polycarbonate, high molecular plastics and the like, would be ideal since their rigidity at the specified 3 MM±15%, would effect the benefits of increased accuracy and articulation.

I claim:

1. A pick for a stringed musical instrument, comprising: an integral body made of a completely rigid material, said body having a thickness of three millimeters, plus or minus fifteen percent, and having at least three picking tips, each of said tips having a different combination of tip shape and tip taper than the remaining tips, and said each tip being located such that only one tip may be used at any one time.

2. A pick defined in claim 1 wherein, a first tip has a small radius of curvature, a second tip has a medium radius of curvature, and a third tip has a larger radius of curvature.

3. The pick as defined in claim 2 wherein, the radius of curvature of the second tip is twice that of the first tip and the radius of curvature of the third tip is twice that of the second tip.

4. The pick as defined in claim 3 wherein the radius of curvature of said first tip is 1.5 millimeters, plus or minus fifteen percent.

5. The pick defined in claim 2, 3, or 4 wherein said first tip is sharply tapered, said third tip is bluntly tapered and said second tip is tapered intermediate the tapers of said first and third tips.

6. The pick as defined in claim 5 wherein the first tip taper is formed by the intersection of two equal arcs tangent to the body, each having a radius of curvature of fifteen millimeters plus or minus fifteen percent, the third tip taper is formed by the intersection of two equal arcs tangent to the body, each having a radius of curvature of 1.5 millimeters plus or minus fifteen percent, and the second tip taper is formed by the intersection of two equal arcs tangent to the body, each having a radius of curvature of three millimeters plus or minus fifteen percent.

* * * * *